US005207039A

United States Patent [19]

Nakatsubo

[11] Patent Number: 5,207,039

[45] Date of Patent: May 4, 1993

[54] FOOTBOARD FOR INDOOR STAIRCASE

[75] Inventor: Masafumi Nakatsubo, Tokyo, Japan

[73] Assignee: Tsuda Corporation, Osaka, Japan

[21] Appl. No.: 795,946

[22] Filed: Nov. 18, 1991

[30] Foreign Application Priority Data

Jul. 8, 1991 [JP] Japan ..... 3-192719

[51] Int. Cl.[5] ..... E04F 11/00

[52] U.S. Cl. ..... 52/189; 52/191; 52/182; 52/188

[58] Field of Search ..... 52/189, 191, 182, 188

[56] References Cited

U.S. PATENT DOCUMENTS

| | | | |
|---|---|---|---|
| 2,867,010 | 1/1959 | Ellman | 52/191 |
| 4,838,005 | 6/1989 | Graham et al. | 52/189 |
| 4,899,504 | 2/1990 | Hirschhorn | 52/191 |

FOREIGN PATENT DOCUMENTS

| | | | |
|---|---|---|---|
| 0442453 | 11/1948 | Italy | 52/189 |
| 1-192949 | 8/1989 | Japan . | |
| 3-2124 | 1/1991 | Japan | 52/189 |

*Primary Examiner*—Carl D. Friedman
*Assistant Examiner*—Wynn E. Wood
*Attorney, Agent, or Firm*—Flynn, Thiel, Boutell & Tanis

[57] ABSTRACT

A footboard for an indoor staircase which is temporarily fixed to notchboards with ease. In fixing the footboard to the notchboards, the lower end portion of a riser of the footboard is made free so that the footboard can be employed in the staircase provided with the same footboards each having different dimensions of the riser. The footboard for an indoor staircase comprises a riser 1 and a footstep portion 2 which is formed integrally with the riser in the L-shape, characterized in that the riser 1 having a hook portion 2 at the upper end thereof, the footstep portion having a lower end portion inclined downward, a rising portion 6 which rises from the end of the inclined lower end portion to a tip end thereof so as to reach a nosing 5 so that the hook portion of the lower positioned footboard can be hooked by the tip end of the rising portion of the upper positioned footboard, and fixing pieces 7 which are welded between the inclined portion 4 of the footstep portion and the rising portion 6.

3 Claims, 1 Drawing Sheet

FOOTBOARD FOR INDOOR STAIRCASE

BACKGROUND OF THE INVENTION

1. Field of the Invention

The present invention relates to a footboard for indoor staircase which is capable of being continuously fixed to notchboards.

2. Prior Art

There has been an indoor staircase comprising a fabricated footboard which is continuously fixed to nochboards by bolts. For example, there are disclosed in Japanese Patent Laid-Open Publication No. 1-192949 that a fixing piece is welded at the boundary close to a riser and a footstep portion and in Japanese Utility Model Laid-Open Publication No. 3-2124 that two fixed nuts are disposed at the lower portion of the footstep.

However, there was a problem in the conventional staircase that the riser has constant dimensions since the height from the fixing position of the bolts to the tip end of the riser is fixed, hence the same footboard can not be used in the same staircase which is provided with the riser having different dimensions caused by the different height of the staircase.

SUMMARY OF THE INVENTION

The present invention has been made in view of the problem of the conventional staircase and is to provide a footboard for indoor staircase capable of permitting a lower end side of a riser of the footboard to be free so that the footboard can be adapted to the staircase which is provided with the same footboards each having different dimensions of the riser and is capable of fabricating temporarily with ease.

To achieve the object of the present invention, the footboard for indoor staircase to be continuously fixed to notchboards is composed of a riser and a footstep portion which is formed integrally with the riser in the L-shape, characterized in that the riser having a hook portion at the upper end thereof, the footstep portion having a lower end portion inclined downward, and a rising portion which rises from the end of the inclined lower portion to a tip end thereof so as to reach a nosing so that the hook portion of the lower footboard can be hooked by the tip end of the riser rising portin of the upper positioned footboard, and fixing pieces which are welded between the inclined portion of the footstep portion and the riser rising portion.

DESCRIPTION OF PREFERRED EMBODIMENT

A footboard for indoor staircase according to a preferred embodiment of the present invention will be described with reference to FIGS. 1 and 2.

Figure 1:
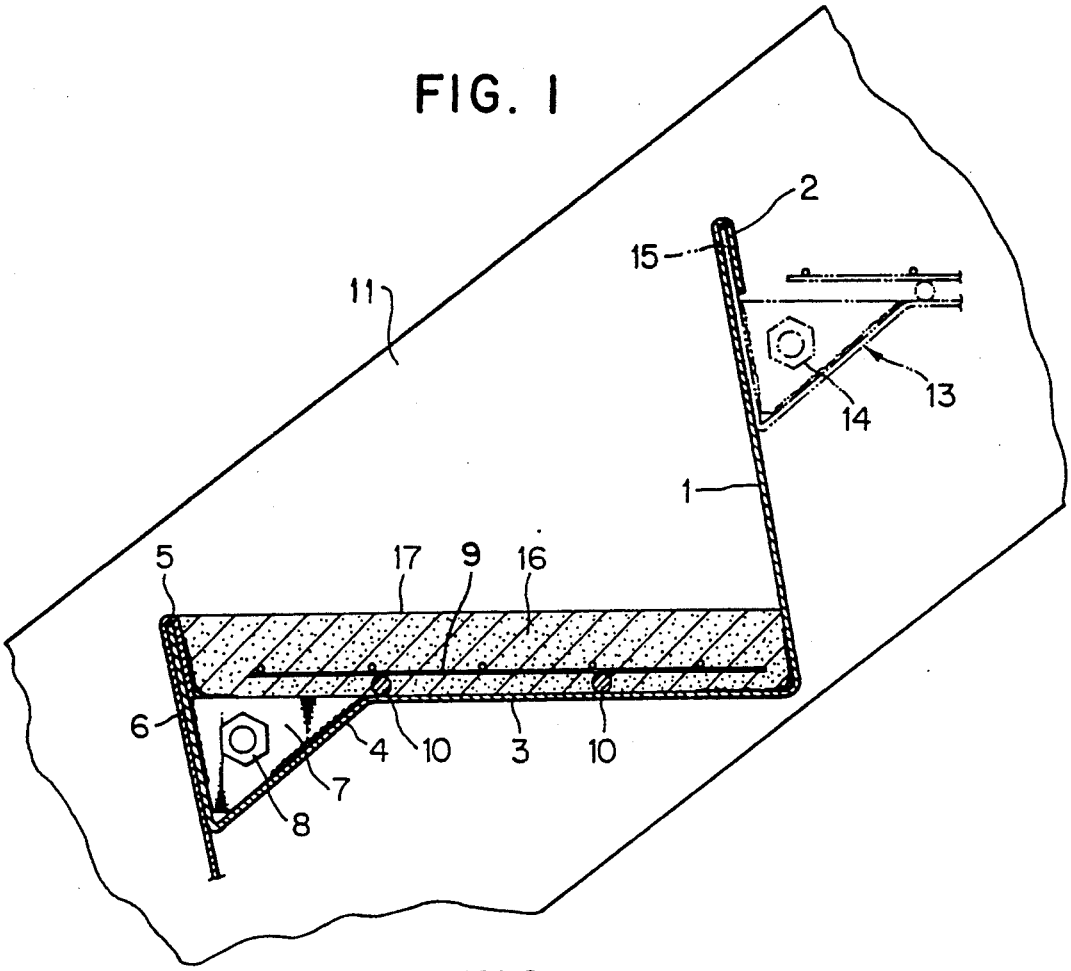
FIG. 1 is a side cross sectional view of a footboard for indoor staircase according to a preferred embodiment of the present invention.
Figure 2:
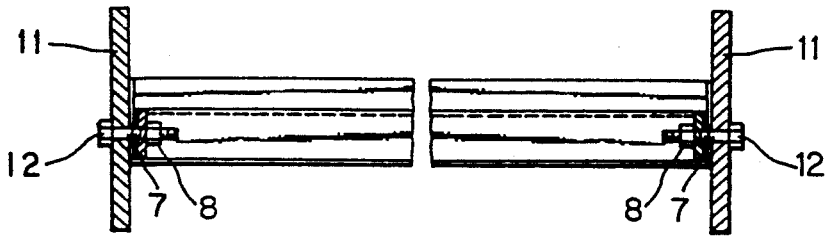
FIG. 2 is a view showing the state where a notchboard and a footboard are combined with each other.

In FIG. 1, the footboard for indoor staircase comprises a riser 1, a hook portion 2 which is disposed over the riser 1 and formed by bending an upper end of the riser 1 in the hook shape and a footstep portion 3 which extends from a lower end of the riser 1 and formed substantially in the L-shape with the riser 1. The riser 1, the hook portion 2 and the footstep portion 3 are integrally formed.

The footstep portion 3 has an inclined portion 4 at the rear end thereof which is inclined downward and a rising portion 6 is continuously formed by bending the rear end of the inclined portion 4 upwardly aslant so as to form a nosing 5 at the given height. A fixing piece 7 is welded between the inclined portion 4 and the rising portion 6 and the fixing piece is attached to the footboard by a nut 8.

Designated at 9 is a wire mesh, 10 is reinforcing rods to support the wire mesh thereon, 11 is a notchboard and 12 is a bolt.

To fabricate the staircase, the footboard can be attached successively to each notchboard 11 in the descending order, i.e. from the upper position to the lower position. That is, when a higher positioned footboard 13 (as illustrated by the chain-dotted line) is temporarily fixed to each notchboard 11 by a bolt 14, the hook portion 2 of the lower positioned footboard is hooked by the rising portion 15 of the higher positioned footboard 13, then the bolt 12 is screwed into the nut 8, which is fixed to the fixing piece 7 from the side of the notchboard 11.

When each footboard is temporarily fixed to the notchboards 11, 11 at the given positions thereof, the upper portion of the riser 1 of each footboard, cornered portions between the riser 1 and the footstep portion 3 and both side surfaces of the rising portion 6 and the fixing pieces 7 are respectively welded to the notchboards 11, 11 and thereafter mortar 16 is deposited in the space defined between the riser 1, the footstep portion 3 and the rising portions 6 at the height same as that of the nosing 5, whereby a footstep surface 17 of the footboard is formed.

Since the position of the nosing 5 is determined by the bolts 12 of the footboard, the position where the bolts 12 are screwed into the nuts 8 is calculated corresponding to the dimensions of the riser 1. When the footboard is attached to the notchboards, if the dimensions of the riser 1 is too long, the step end of the footboard is slightly lowered, while if the dimensions of the risers 1 is too short, the step end of the footboard is slightly raised. Accordingly, the footboard of the present invention can be adapted for the staircase provided with same footboard each having the different dimensions of the riser 1. Even if there is any vertical deviation of the lower end of the riser, the footstep surface 17 can be kept in parallel with the floor by depositing the mortar.

Since the footboard for indoor staircase according to the present invention includes the hook portion at the upper end of the riser, the footstep portion having the rear end inclined downward, the rising portion rising aslant from the inclined end of the footstep portion to reach the nosing so that the hook portion of the lower positioned footboard is hooked by the tip end of the rising portion of the upper footboard, and fixing pieces which are welded between the inclined portion of the footstep portion and the rising portion, the footboards are hooked and arranged in descending direction, i.e. from the upper footboard to the lower footboard and merely fixed to the notchboards by bolts. As a result, the staircase can be manufactured with safety, simplicity and ease and expedition.

Even if there is any difference or deviation in the dimensions of the riser caused by the height of the staircase, this difference can be absorbed by the lower end portion of the riser. Accordingly, it is possible to mass produce the footboards previously in the factory and stock with the footboards, which involve the lower cost.

What is claimed is:

1. A footboard for an indoor staircase, said footboard being adapted to be fixed to notchboards, comprising:

a riser, a footstep portion which is formed integrally with said riser in an L-shaped and extends forwardly from said riser, said riser having a hook portion at an upper end thereof, said footstep portion having a forward end and a downwardly and forwardly inclined lower end portion at the forward end thereof opposite said riser, a rising portion extending upwardly from a lower edge of said inclined lower end portion, said rising portion extending above an upper surface of said footstep portion and defining an upstanding rim on a forward end of the upper surface of said footstep portion so that the hook portion of another similarly constructed footboard can be hooked on said rim of said footstep portion, said inclined lower end portion and a section of said rising portion that is below said footstep portion defining an upwardly opening cavity; and fixing pieces which are welded between said inclined portion of said footstep portion and said rising portion in said cavity.

2. An elongated footboard for an indoor staircase, comprising:

a substantially horizontal footstep portion having first and second ends, an upright riser integral with and extending upwardly from said first end of said footstep portion so as to define therewith a substantial L-shape, said upright riser having a reversely curved section at an upper end thereof defining a downwardly opening, inverted, substantially U-shaped hook located on an opposite side of said upright riser from said footstep portion;

a downwardly inclined wall section integral with and extending away from said second end of said footstep portion, an upright nose wall section integral with and extending upwardly from a lower end of said downwardly inclined wall section, said upright nose wall section extending to a location above an upper surface of said horizontal footstep portion so that a hook of another similarly constructed footboard can be hooked over an upper part of said upright nose wall section to couple said footboards together, said downwardly inclined wall section and a portion of said upright nose wall section below the upper surface of said horizontal footstep portion defining an upwardly opening, substantially triangular cavity having a width and a depth;

substantially triangular fixing pieces fixedly mounted in and substantially filling the width and depth of said triangular cavity;

a nut affixed to each of said triangular fixing pieces so that said fixing pieces can be bolted to notchboards;

a horizontal concrete tread on said footstep portion and extending upwardly so as to be substantially flush with the upper part of said upright nose wall section; and said footboard being free of nuts for connecting said footboard to notchboards except at said triangular fixing pieces.

3. An elongated footboard for an indoor staircase, comprising:

a substantially horizontal footstep portion having first and second ends, an upright riser extending upwardly from said first end of said footstep portion so as to define therewith a substantially L-shape, said riser having a downwardly opening hook located on an opposite side of said riser from said footstep portion;

a downwardly extending wall section at said second end of said footstep portion, an upright nose wall section extending upwardly from a lower end of said downwardly extending wall section, said upright nose wall section extending to a location above an upper surface of said horizontal footstep portion and defining an upstanding rim so that a hook of another similarly constructed footboard can be hooked over said upstanding rim of said upright nose wall section to couple said footboards together, said downwardly extending wall section and a portion of said upright nose wall section below the upper surface of said horizontal footstep portion defining a cavity having a width and a depth;

fixing pieces fixedly mounted in and substantially filling the width and depth of said cavity; and releasable fastener means affixed to each of said fixing pieces so that said fixing pieces can be fastened to notchboards, said footboard being free of releasable fastening means for connecting said footboard to notchboards except at said fixing pieces.

* * * * *